United States Patent [19]

Lyon

[11] 4,185,926

[45] Jan. 29, 1980

[54] SAFE-GEOMETRY PNEUMATIC NUCLEAR FUEL POWDER BLENDER

[75] Inventor: Ward L. Lyon, Monroeville, Pa.

[73] Assignee: Westinghouse Electric Corp., Pittsburgh, Pa.

[21] Appl. No.: 882,037

[22] Filed: Feb. 28, 1978

[51] Int. Cl.[2] ..... B01F 13/02

[52] U.S. Cl. ..... 366/101

[58] Field of Search ..... 366/101, 105, 106, 107, 366/341; 176/37

[56] References Cited

U.S. PATENT DOCUMENTS

| | | | |
|---|---|---|---|
| 3,145,975 | 8/1964 | Towns | 366/101 |
| 3,164,376 | 1/1965 | Clark | 366/101 |
| 3,388,894 | 6/1968 | Harrison | 366/101 |
| 3,582,046 | 6/1971 | Mueller | 366/106 |
| 3,647,188 | 3/1972 | Scott | 366/101 |
| 3,746,312 | 7/1973 | Pirk | 366/101 |
| 3,807,705 | 4/1974 | Humkey | 366/101 |
| 3,825,230 | 7/1974 | Frye | 366/105 |
| 3,871,626 | 3/1975 | Wohlfarth | 366/101 |
| 3,881,702 | 5/1975 | McIver | 366/101 |

FOREIGN PATENT DOCUMENTS

| | | | |
|---|---|---|---|
| 1146734 | 4/1963 | Fed. Rep. of Germany | 366/101 |

*Primary Examiner*—Robert W. Jenkins

*Attorney, Agent, or Firm*—J. R. Campbell; Z. L. Dermer

[57] ABSTRACT

A safe geometry nuclear fuel powder blender of a pneumatic type having a plurality of narrow flat-walled blending chambers or "slab tanks" extending radially outward from a pneumatic spouting tube having an inlet and an outlet at bottom and top, respectively, open to each slab tank or blending chamber and contained within a cylindrical cone-bottomed shell filled with neutron-absorbing material between the blending chambers.

5 Claims, 3 Drawing Figures

SAFE-GEOMETRY PNEUMATIC NUCLEAR FUEL POWDER BLENDER

BACKGROUND OF THE INVENTION

1. Field of the Invention

A safe-geometry pneumatic nuclear fuel powder blender.

2. Description of the Prior Art

In the fabrication of nuclear fuel it is necessary to blend large volumes of powders containing fissile material. A geometrically favorable equipment design can be employed for the blending chamber to prevent accumulation of a critical mass of the fissile material during the blending operation. One geometrically favorable design is a narrow rectangular tank, referred to as a "slab tank", as disclosed in U.S. Pat. No. 3,746,312 of Hans Pirk, for example, which exemplifies a relatively high degree of simplicity. Such a slab tank may range in thickness from about two-and-one-half inches to about seven-and-one-half inches, depending upon the type and concentration of fissile material being blended. The FIG. 3 version of the Pirk slab tank blender is described as being air operated to obtain a fluidized bed having upward and downward moving components arrived at by variable automatic preselected discharges from spaced-apart sites in a porous bottom member of the slab tank. Under not uncommon circumstances, however, the fissile material powder particles to be blended may be of such degree of fineness that the establishment of the counterflowing fluidized bed action relied on for the powder blending becomes difficult if not impossible to obtain, irrespective of tank width, and the technique becomes limited to blending of heavier powders, capable of fluidized bed action. At large tank widths to handle larger powder volumes, eight feet for example, excessive blending time and complex wall stiffening structures are required.

SUMMARY OF THE INVENTION

The present invention obtains an increased safe-geometry mixing volume for fine-particle nuclear fuel powders in a pneumatically-operated blender by provision of a circular array of radially-extending slab tanks or thin rectangular blending chambers compactly arranged within a cone-bottomed shell and activated by a central pneumatic spouting on updraft tube common to each blending chamber. Neutron absorbing material is disposed in the shell between the slab-tank blending chambers for effective isolation of their fissile material contents. A pneumatically-fed porous bottom plate assists flow of particles thereover at the bottom of each blending chamber, particularly during unloading of the blended powder material which occurs by downward flow to the central lower end of the cone-bottomed shell to a combined discharge control valve and spouting nozzle at the lower end of the spouting tube. A filtered exhaust assembly permits of withdrawal of air from the blending chambers at the same rate as entry thereto via spouting tube and porous bottom. Powder inlet tubes provide for the charging of the slab-tank blending chambers in upper regions thereof with the nuclear fuel fissile powders to be blended.

DESCRIPTION OF THE PREFERRED EMBODIMENT

Figure 1:
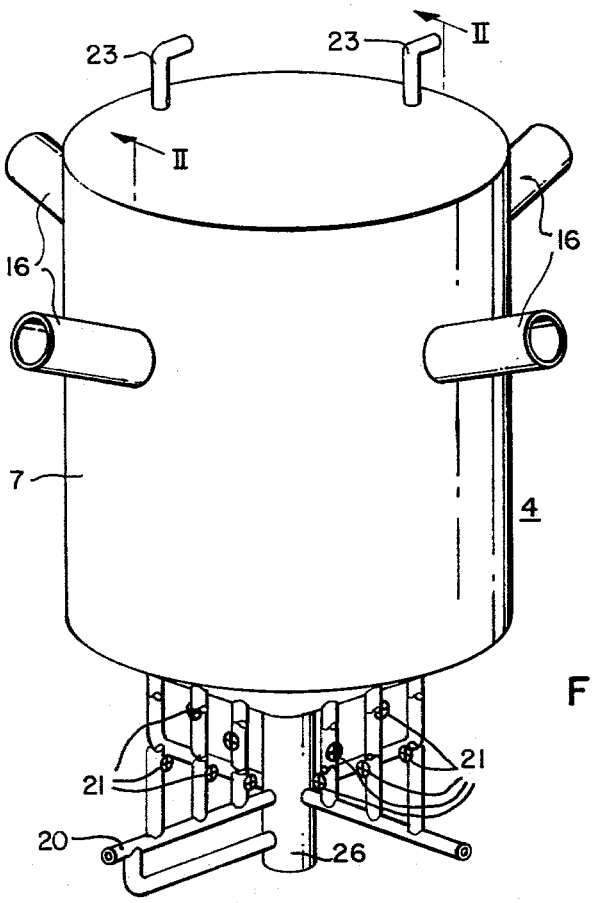
FIG. 1 is a three dimensional isometric view of an illustrative embodiment of the nuclear fuel powder blender of the present invention in a preferred form as presently conceived.

Referring to the several figures in the drawing, the pneumatic nuclear fuel powder blender 4 of the present invention comprises a plurality, four being exemplified in the drawing, of thin flat rectangular slab-tank-type blending chambers 5 extending radially outward from a common spouting tube 6. The chambers 5 are disposed within a cone-bottomed cylindrical shell 7 and are defined thicknesswise by parallel side walls 8 extending radially inward from the outer wall of the shell 7 to a transverse wall 9 that forms a side wall of the spouting tube 6 at the center of the shell. The spouting tube walls 9 have powder inlet ports 10 adjacent to the lower ends of downwardly tapering porous bottom walls 11 of the blending chambers 5 and powder outlet ports 12 opening into such chambers at an effective working height above the bottom walls 11 and at some overhead clearance distance beneath the top wall 14 of the shell 7 which closes the tops of the blending chambers 5. A flow diverter member 15 closes the top of the spouting tube 6 immediately above the outlet ports 12. Powder-inlet filler tubes 16 open through the outer wall of the shell 7 into the chambers 5 at a site about equal to the height of the diverter member 15 in the spouting tube 6 for introduction of fissile material powders to be blended. The downwardly slanting porous bottom walls 11 of the blending chambers 5 are disposed slightly above and parallel to the conical bottom wall 17 of the shell 7 to form pneumatic supply chambers 18 for the porous walls 11. Partitions 19 segregate the chambers 18 one from the other. Three chambers 18 distributed along the length of each bottom wall 11 is exemplified in the illustrative embodiment. More or fewer numbers of these chambers may be found to be necessary. Each chamber 18 is availed of compressed air via a pneumatic supply line 20 and branches thereof, together with respective valves 21 for controlling flow and admission of compressed air to the chambers 18. Near the top of each blending chamber 5 are located a number of filtered exhaust members 22 connected to vacuum exhaust duct means 23. At the bottom of the spouting tube there is a combination exhaust valve and spouting nozzle member 25. In one operative position of member 25, compressed air is directed upwardly through the spouting tube 6 at a high velocity, and in a second operative position of such member the bottom of such spouting tube is opened to a blended powder outlet spout 26 continuing downwardly from such spouting tube. Between the blending chambers 5 and confined within the shell 7 there is disposed a neutron isolator material 30, one containing hydrogen atoms, for example, capable of slowing down neutrons from fissile material in the blending chambers. Such neutron absorbing material being concrete 31 as shown, or, water, paraffin, polyethylene beads, etc. Such material, by dint of its rigidity or density, assists in support of the side walls 8 against the pneumatic pressurization within, which pressurization, although slight, less than five p.s.i. may, for example, tend to create a considerable force on such walls due to their relatively large area of exposure to such pressure. With such external support from the neutron absorbing material, the walls 8 may be made somewhat thinner and/or less rigidizing structure employed than otherwise would be found necessary. Where the neutron absorbing material is in the form of loose fill, such as polyethylene beads, for example, a pneumatically-availed porous bottom may be disposed beneath such fill to effect pressurization of the exterior of the respective walls 8 into equality with the chamber 5 pressure on the other side.

In operation, the blending chambers 5 are filled with powdered fissile material, such as uranium dioxide, plutonium dioxide, etc., to a maximum level of slightly below the powder outlets in the spouting tube 6 by introducing powders through the filler tubes 16 assisted by such as withdrawal of air from such blending chambers via the filters 22 and vacuum exhaust duct means 23 at the top of the shell 7. The width of the chambers will be designed to be no greater than the safe layer thickness for the fissile component of the material to be blended, in accord with well-known practice, and this may be in the order of five and one-half inches when working with such as four percent enriched uranium dioxide. The width and useful height dimensions may be made to accomodate a considerable volume in excess of the so-called safe volume amount by virtue of abiding by the safe-layer-thickness limitation. For example, the four-chamber embodiment exemplified in the drawing may have a working height within chambers 5 of three feet, for example, and a shell diameter of four and one-half feet to give a working capacity of seven hundred kilograms.

Figure 2:
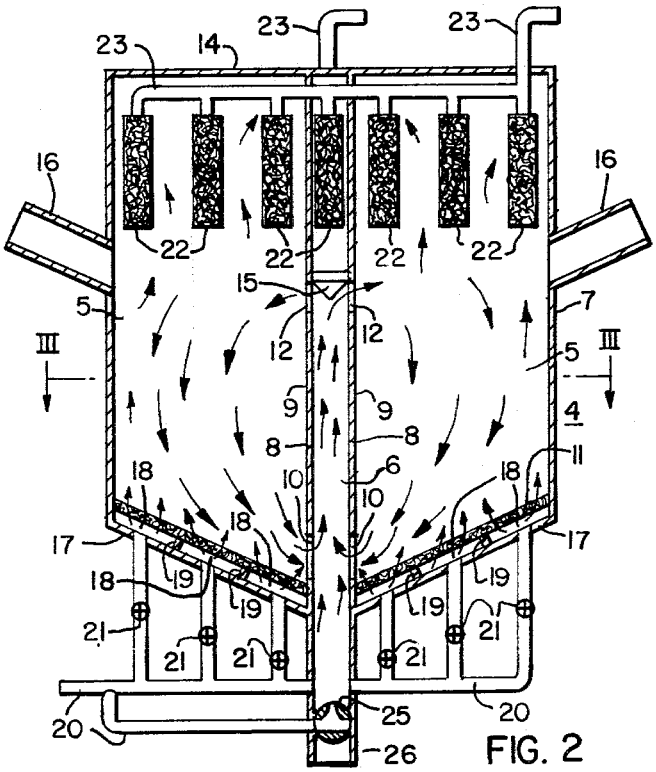
FIGS. 2 and 3 are vertical and horizontal section views of the blender taken along the lines II—II and III—III in FIGS. 1 and 2, respectively.
Figure 3:
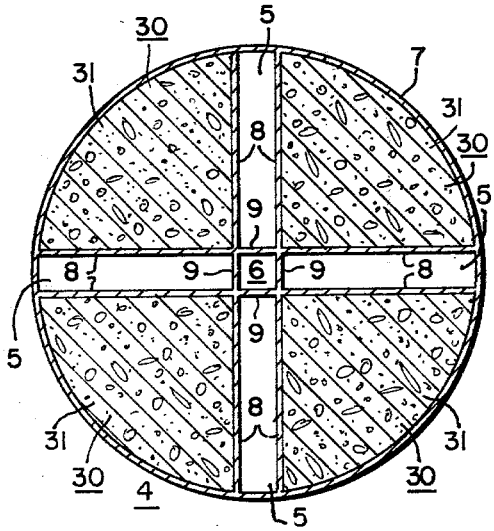

Once filled with the fissile material powder to be blended, the filler tubes will be closed, and the spouting tube 6 brought into play by turning of the rotary valve 25 to the position in which it is shown in FIG. 2, wherein such valve becomes a spouting nozzle to cause high velocity compressed air to travel upwardly through such spouting tube, while an equal amount of air is quiescently withdrawn from the tops of the blending chambers via the exhaust duct means 23 and the filter members 22. The high velocity upward flow of compressed air through the spouting tube 6 past the powder inlet ports 10 at the bottom inner regions of the blending chambers 5 will cause withdrawal of the powdered fissile material therefrom into and upwardly through such spouting tube to the diverter member 15 at the top of the mixing region and into the blending chambers 5 via the exit ports 12. Such powder flow into the bottom and out of the top of the spouting tube causes downward circulation and mixing of the powdered fissile material through the several blending chambers 5 simultaneously. After a period of time sufficient to complete such mixing or blending, the valve member 25 may be turned to a cutoff position to terminate supply of spouting air to the spouting tube 6. The blended powdered fissile material may be stored in the chambers 5 until needed, if desired, whereupon the valve member will be turned to a position connecting the bottom of the spouting tube 6, hence the inner bottom portions of the blending chambers 5 via ports 10, to the blended powder outlet 26 below the valve. The powder will thereby exit such chambers via such valve 25 and outlet 26, either by influence of gravity, and/or by pneumatic inducement, which can be brought about by flow of compressed air upwardly through the porous bottom walls 11 of the blending chambers 5 during a time, for example, when withdrawal of air via the exhaust ducts 23 is diminished or ceased momentarily. Flow via the porous bottom walls 11 also may be employed during the blending operation by the spouting tube to further aerate the powder and aid flow through the blending chambers 5 and prevent any adherence of powder to the chamber surfaces which would act to bypass the mixing action. The pneumatic flow through the several regions of the porous bottom walls 11 fed from the different chambers or supply regions 18 can be regulated by the several control valves 21 to optimize the action, which may be enhanced by flow pulsation, for example, or local flow differentials.

It will be appreciated that the number of blending chambers 5 may be greater than four exemplified, five or six, for example, to further expand the working volume while preserving the compactness of the overall dimensions of the shell 7. It also may be possible to employ one filler tube 16 for all blending chambers 5, rather than a filler tube for each as shown in the drawing. In the case of a single filler tube 16, powder introduced via the one filler tube to one chamber will become distributed to all chambers 5 by operation of the spouting tube 6.

Having now described the invention, what is claimed is:

1. A safe-geometry powdered nuclear fuel blender comprising:

a circular array of narrow vertical circumferentially spaced-apart blending chamber means;

a cylindrical shell coaxial with said array and containing neutron absorbing material in disposition between said blending chamber means;

filler means for introducing powdered nuclear fuel material into said blending chamber means;

an updraft spouting tube means extending vertically at the center of said circular array and having powder inlet and outlet openings into the several blending chamber means of such array at upper and lower regions thereof;

pneumatic means for effecting flow of gas upwardly through said updraft spouting tube means for inducing circulation of said powdered material through said blending chamber means via said inlet and outlet openings; and exit means for the blended powdered fuel material.

2. The safe-geometry powdered nuclear fuel blender of claim 1, wherein, each of said blending chamber means has a bottom slanting downwardly toward said spouting tube means.

3. The safe-geometry powdered nuclear fuel blender of claim 1, wherein, the blended powdered fuel exit means includes a means for connection of the bottom of said spouting tube means to a blended fuel discharge opening.

4. The safe-geometry powdered nuclear fuel blender of claim 1, wherein bottom walls of said blending chambers are compressed air pervious and said blender further includes means for effecting upward flow of gas through said bottom walls.

5. The safe-geometry powdered nuclear fuel blender of claim 1, wherein said pneumatic means includes means for connection of the lower end of said updraft tube means to a source of compressed gas, and filtered gas exhaust means open to upper regions of said blending chamber means.

* * * * *